US009803875B2

(12) United States Patent
Barber et al.

(10) Patent No.: US 9,803,875 B2
(45) Date of Patent: Oct. 31, 2017

(54) ELECTRIC OVEN WITH A HEATING ELEMENT REFLECTOR

(75) Inventors: Judith Barber, Trent Woods, NC (US); Joseph Geiger, Trent Woods, NC (US); Tao Geng, New Bern, NC (US); Michael Gerdes, Trent Woods, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 1699 days.

(21) Appl. No.: 13/019,345

(22) Filed: Feb. 2, 2011

(65) Prior Publication Data

US 2012/0193337 A1 Aug. 2, 2012

(51) Int. Cl.
*F24C 15/22* (2006.01)

(52) U.S. Cl.
CPC ..... *F24C 15/22* (2013.01)

(58) Field of Classification Search
USPC ..... 392/405, 420, 423–425, 428; 219/384, 219/400, 405, 421
See application file for complete search history.

(56) References Cited

U.S. PATENT DOCUMENTS 1,721,099 A * 7/1929 Wiegand ..... 219/536
2,257,366 A 9/1941 Bates et al.
3,322,946 A * 5/1967 Cooper ..... 362/2
3,600,553 A * 8/1971 Costello ..... 392/421
4,238,995 A * 12/1980 Polster ..... A47J 37/0635 219/411
4,533,820 A * 8/1985 Shimizu ..... 219/411
4,535,753 A 8/1985 Zayauskas
4,629,865 A * 12/1986 Freedman et al. ..... 219/405
4,728,777 A * 3/1988 Tsisios et al. ..... 392/418
4,789,771 A * 12/1988 Robinson et al. ..... 219/405
4,859,832 A * 8/1989 Uehara et al. ..... 219/411
5,156,820 A * 10/1992 Wong et al. ..... 422/186.05
5,740,314 A * 4/1998 Grimm ..... 392/420
5,801,362 A 9/1998 Pearlman et al.
(Continued)

FOREIGN PATENT DOCUMENTS

JP 3017428 B2 1/1991
TR WO2007141304 A2 12/2007

OTHER PUBLICATIONS

Crowell, Benjamin. Light and Matter, ed. 2.1 (2004) p. 42, ISBN 0-9704670-5-2.*

*Primary Examiner* — David Angwin
*Assistant Examiner* — Lawrence Samuels
(74) *Attorney, Agent, or Firm* — Michael E. Tschupp; Andre Pallapies; Brandon G. Braun

(57) ABSTRACT

An electric oven with a heating element designed to conduct broiling operations includes a reflector that is mounted between the heating element and a ceiling of a cooking cavity. The reflector can include reflecting portions that extend downward from side, rear or front edges of the reflector to help focus radiant energy produced by a heating element downward onto an underlying cooking surface. The reflector can also include a plurality of curved segments that are designed to reflect radiant energy emitted upward by the heating element back downward onto an underlying cooking surface. The curved segments can have varying focal lengths to help more evenly distribute the reflected radiant energy across the underlying cooking surface.

17 Claims, 5 Drawing Sheets

(56) References Cited

U.S. PATENT DOCUMENTS

| | | | | |
|---|---|---|---|---|
| 5,805,769 | A * | 9/1998 | Cook et al. | 392/421 |
| 6,018,146 | A * | 1/2000 | Uzgiris et al. | 219/405 |
| 6,057,528 | A | 5/2000 | Cook | |
| 6,337,466 | B1 | 1/2002 | Chasen | |
| 6,570,134 | B2 * | 5/2003 | Suzuki et al. | 219/390 |
| 6,707,011 | B2 * | 3/2004 | Tay et al. | 219/411 |
| 6,862,404 | B1 * | 3/2005 | Yoo | 392/416 |
| 7,038,173 | B2 * | 5/2006 | Takahashi et al. | 219/390 |
| 7,105,778 | B1 | 9/2006 | DeLong et al. | |
| 7,323,663 | B2 | 1/2008 | Cavada et al. | |
| 7,592,570 | B2 | 9/2009 | Yoder et al. | |
| 2002/0162832 | A1 * | 11/2002 | Boehnke | 219/388 |
| 2003/0141290 | A1 | 7/2003 | Backer et al. | |
| 2003/0146200 | A1 * | 8/2003 | Takahashi et al. | 219/390 |
| 2006/0051078 | A1 * | 3/2006 | Bonnin et al. | 392/423 |
| 2010/0000659 | A1 | 1/2010 | Takada et al. | |

* cited by examiner

ELECTRIC OVEN WITH A HEATING ELEMENT REFLECTOR

BACKGROUND

Many conventional electric ovens include one or more heating elements mounted at the top of the cooking cavity. These heating elements can be used to heat the cooking cavity to a predetermined temperature. Once the cooking cavity reaches a desired temperature, the heating element is switched on and off to keep the cooking cavity at the desired temperature.

Heating elements located at the top of the cooking cavity can also be used to broil food items located on a rack positioned under the heating elements. During a broiling operation, the heating elements are typically switched on continuously. This causes the heating elements to glow and to emit large amounts of radiant heat.

FIG. 1 is a cross-sectional view of a conventional oven 100 with a cooking cavity 102. A heating element 107 for the oven is illustrated in FIG. 2. As shown in FIG. 2, the heating element 107 includes a plurality of straight segments 110 that are joined to one another by connecting segments 113. The ends of the heating element 107 include electrodes 111 which are coupled to a source of electricity.

A rack 106 in the oven provides a cooking surface. The rack can be positioned at different levels within the cooking cavity using rails 104 that are located at different heights within the cooking cavity 102. Thus, food items can be positioned closer to or farther away from the heating element during a broiling operation.

Ovens with a heating element 107 used to conduct broiling operations can include a heat shield or a reflector 109 positioned above the heating element, between heating element 107 and the top wall of the cooking cavity. During a broiling operation, when the heating element 107 remains switched on for long periods of time, the reflector 109 blocks some of the heat produced by the heating element from reaching and damaging portions of the oven located above the heating element. In addition, the reflector 109 can reflect radiation or radiant heat emitted upward from the heating element 107 back downward onto the food items located on the rack 106. This helps to ensure that more of the heat energy produced by the heating element reaches the food items on the rack 106 to conduct a cooking operation.

SUMMARY

When a broiling operation is conducted with an oven as illustrated in FIG. 1, food items located at the center of the oven rack 106 tend to receive a greater amount of heat energy than food items located at sides of the rack 106. As a result, food items located at the center of the rack will finish cooking more quickly than food items located at the sides of the rack. In part, this occurs because a portion of the radiant energy emitted by the straight segments 110 located at the left and right sides of the cooking cavity travels sideways away from the heating element. Likewise, a portion of the radiant energy emitted from the connecting segments 113 travels sideways towards the front and rear walls of the cooking cavity. These portions of the radiant energy do not travel directly down to the food items located on the rack 106.

DETAILED DESCRIPTION

Figure 1:
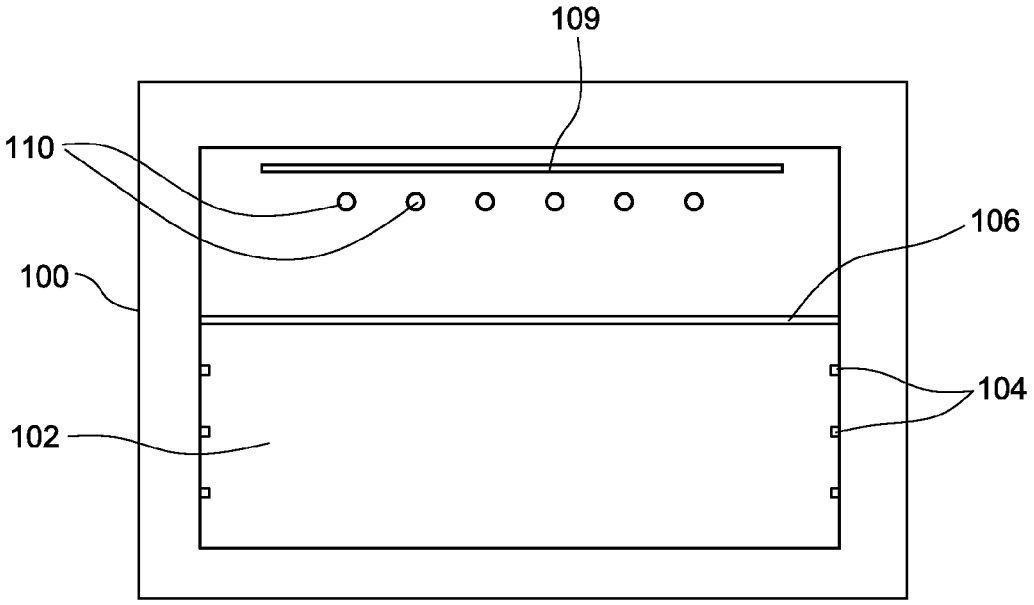
FIGURE 1 BACKGROUND ART
FIG. 1 is cross-sectional view of an oven.
Figure 2:
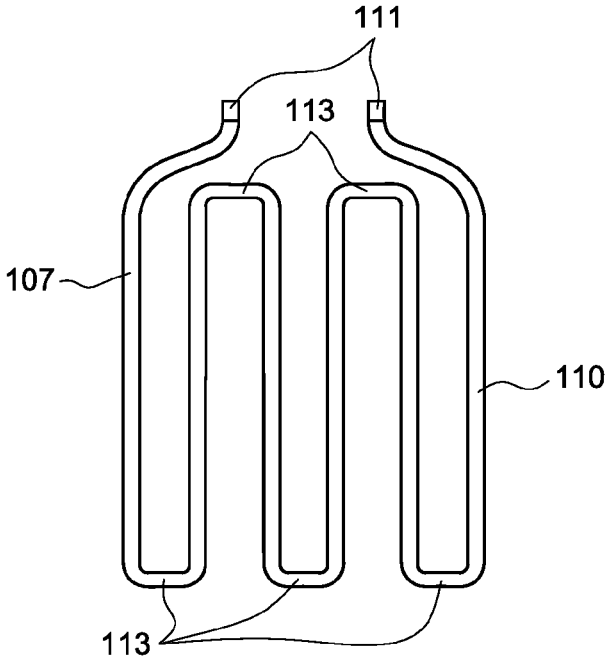
FIGURE 2 BACKGROUND ART
FIG. 2 is a top view of a heating element that can be mounted at the top of an electric oven.
Figure 3:
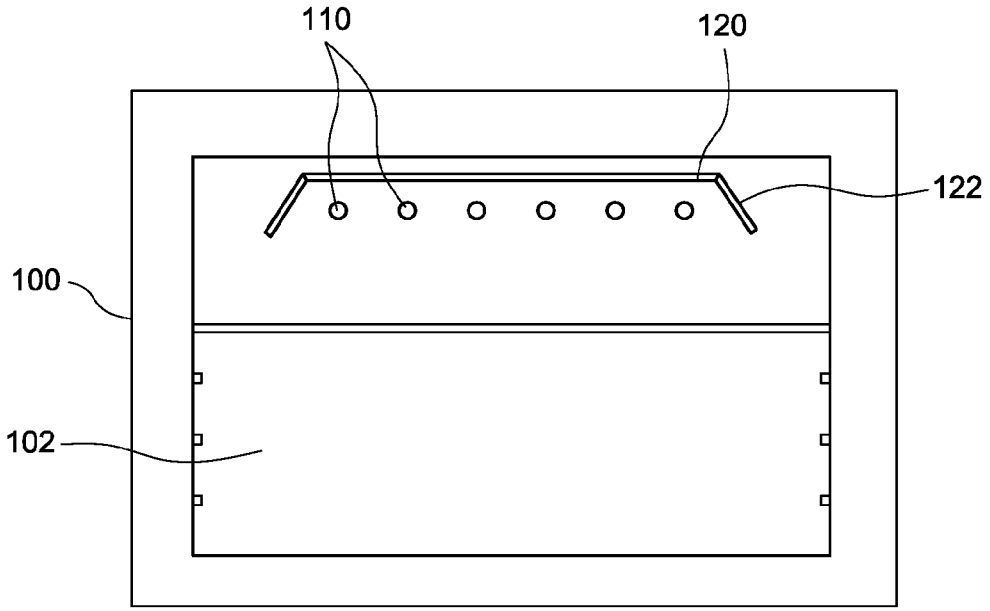
FIG. 3 is cross-sectional view of an oven having a reflector with angled side reflecting portions.

FIG. 3 is a cross-sectional view of an oven having a reflector 120 with side reflecting portions 122. The side reflecting portions 122 extend downward from side edges of the main body of the reflector 120. In this embodiment, the side reflecting portions 122 form an oblique angle with respect to the main body of the reflector 120.

The side reflecting portions 122 reflect radiant energy emitted by the straight segments 110 of the heating element located at the left and right sides of the cooking cavity downward towards the top surface of the rack 106 located under the heating elements 110. The side reflecting portions 122 are particularly effective in reflecting radiant energy emitted sideways from the outermost straight segments 110 of the heating element downward. This radiant energy would otherwise travel sideways towards the left and right sidewalls of the cooking cavity 102. By reflecting the radiant energy downward, more of the radiant energy emitted from the outermost straight segments 110 of the heating element ultimately reaches the food items on the rack 106. This can decrease the amount of time required to cook the food items on the sides of the rack 106, and it can also result in more even cooking of the items located across the rack 106. In other words, food items located at the edges of the rack 106 will tend to cook at approximately the same speed as food items located at a center of the rack 106.

Figure 4:
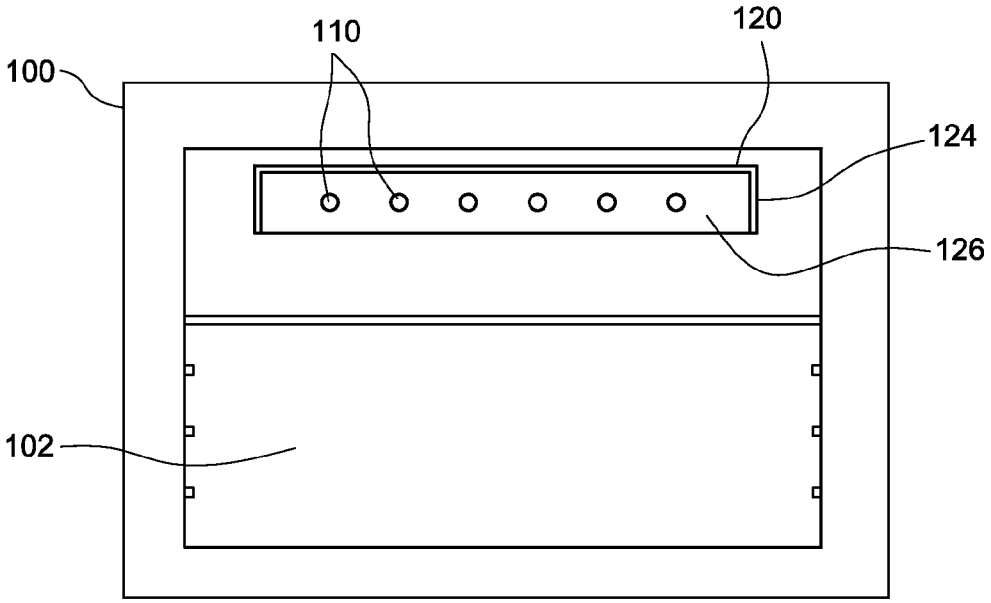
FIG. 4 is a cross-sectional view of an oven with a reflector having side reflecting portions and a rear reflecting portion.

FIG. 4 illustrates another embodiment where a reflector 120 includes side reflecting portions 124. In this embodiment, the side reflecting portions 124 form a perpendicular angle with the main body portion of the reflector 120. Adjusting the angle between the side reflecting portions and the main body portion of the reflector can help to focus more or less of the radiant energy produced by the portions of the heating element located at the sides of the cooking cavity downward toward the rack 106.

The reflector illustrated in FIG. 4 also includes a rear reflecting portion 126. The rear reflecting portion also helps to reflect radiation emitted from the rear portion of the heating element downward toward the rack 106. For instance, the rear reflecting portion 126 would be effective at reflecting radiant energy emitted sideways by connecting segments 113 at the rear of the heating element downward. The angle formed between the main body portion of the reflector and the rear reflecting portion 126 could also be adjusted to control the amount of radiation reflected downward towards the rack 106.

Figure 5:
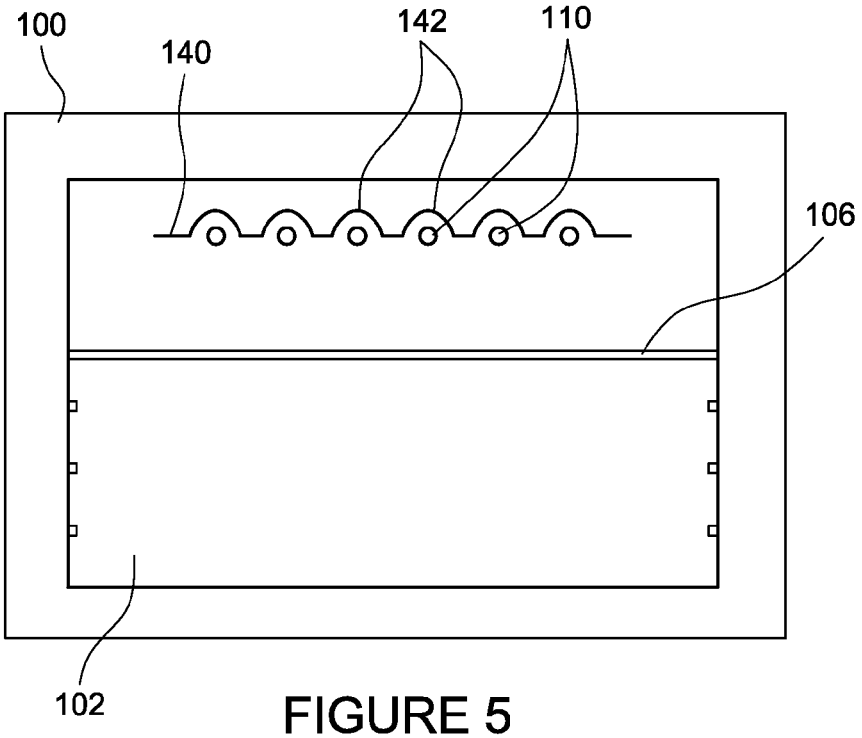
FIG. 5 is a cross-sectional view of an oven with a reflector having curved segments.

FIG. 5 illustrates an oven with a reflector 140 that includes a plurality of curved segments 142. Each curved segment 142 surrounds a corresponding straight segment 110 of the heating element. The curved segments are intended to better focus the radiant energy emitted upward by the straight segments 110 of the heating element downward towards the top of the rack 106. In some instances, the curved segments 142 could have a parabolic shape.

In the embodiment illustrated in FIG. 5, the shapes of the curved segments 142 of the reflector 140 are all essentially identical. Thus, the radiant energy emitted upward by the straight segments 110 of the heating element located at the center of the cooking cavity will be reflected downward in the same fashion as the radiant energy emitted upward by the straight segments 110 located at the left and right sides of the cooking cavity.

Because some of the radiant energy produced by all of the straight segments 110 is reflected downward by the curved segments 142 at an angle to the vertical direction, a substantial portion of the radiant energy reflected downward from the straight segments located at the left and right sides of the cooking cavity will travel to the sidewalls of the cooking cavity, rather than straight down onto food items on the rack 106. In contrast, the majority of the radiation reflected downward from the straight segments 110 located at the center of the cooking cavity will ultimately travel downward onto food items on the rack 106. The net result is that a greater amount of energy reaches the center portions of the rack than the sides of the rack 106.

Figure 6:
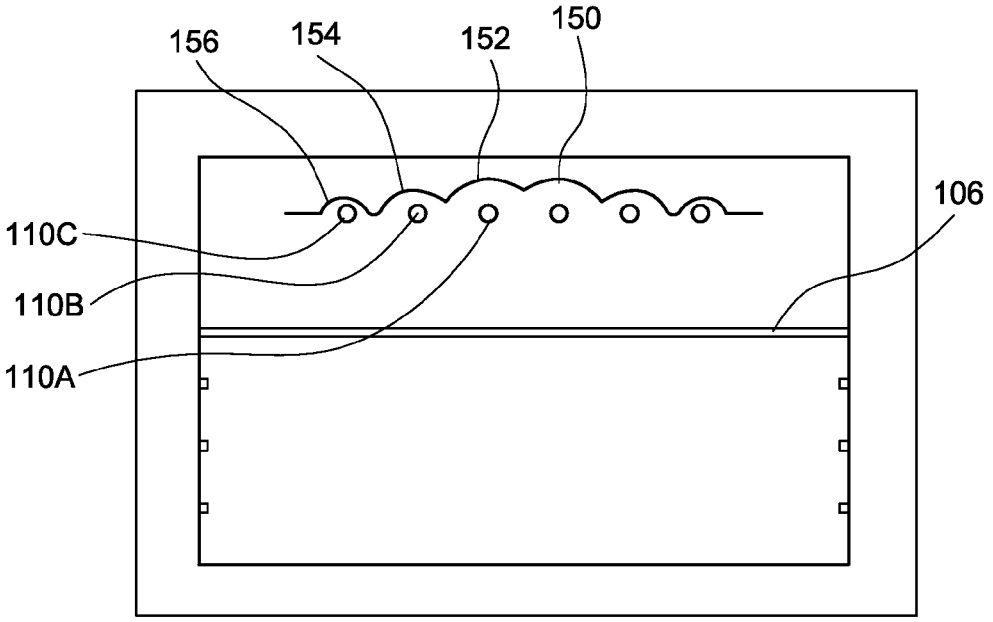
FIG. 6 is a cross-sectional view of an oven with a reflector having curved segments with varying focal lengths.

An oven having a different type of reflector that is designed to produce more even cooking across the rack is illustrated in FIG. 6. In this embodiment, the reflector 150 still includes a plurality of curved segments 152, 154, 156. Here again, each curved segment surrounds a corresponding one of the straight segments 110 of the heating element. However, the curved segments are not all alike. Instead, the curved segments 152 located towards the center of the cooking cavity have a longer focal length than the curved segments 156 located at the left and right sides of the cooking cavity. In this embodiment, the farther toward the side edge that a curved segment is located, the smaller the focal length of the curved segment.

Because the curved segments 152 at the center of the cooking cavity have a large focal length, radiant energy reflected downward from the straight segments 110 of the heating element located at the center of the cooking cavity are reflected downward a large angle with respect to the vertical direction. In other words, the radiant energy reflected downward from the straight segments 110 located at the center of the cooking cavity is reflected off towards the left and right sides of the rack 106. In contrast, because the curved segments 156 located at the left and right sides of the cooking cavity have a smaller focal length, the radiant energy reflected downward from the straight segments 110 located at the sides of the cooking cavity are reflected almost straight down onto the underlying portions of the rack 106.

Because of the varying focal lengths of the curved portions 152, 154, 156 of the reflector 150 illustrated in FIG. 6, this reflector tends to focus more of the reflected radiant energy on the sides of the rack 106 than a reflector as illustrated in FIG. 5. And this, in turn, produces more even cooking of the food items distributed across the rack 106.

In the embodiment illustrated in FIG. 6, because the curved segments 152 of the reflector located toward the center of the cooking cavity have a large focal length, these segments are located relatively far away from the corresponding straight segments 110 of the heating element. In contrast, because the curved segments 156 of the reflector located at the sides of the cooking cavity have a small focal length, these curved segments are located relatively close to the corresponding straight segments 110. The reflector has a shape that results in the varying spacing between the curved segments and the straight segments of the heating element.

Figure 7:
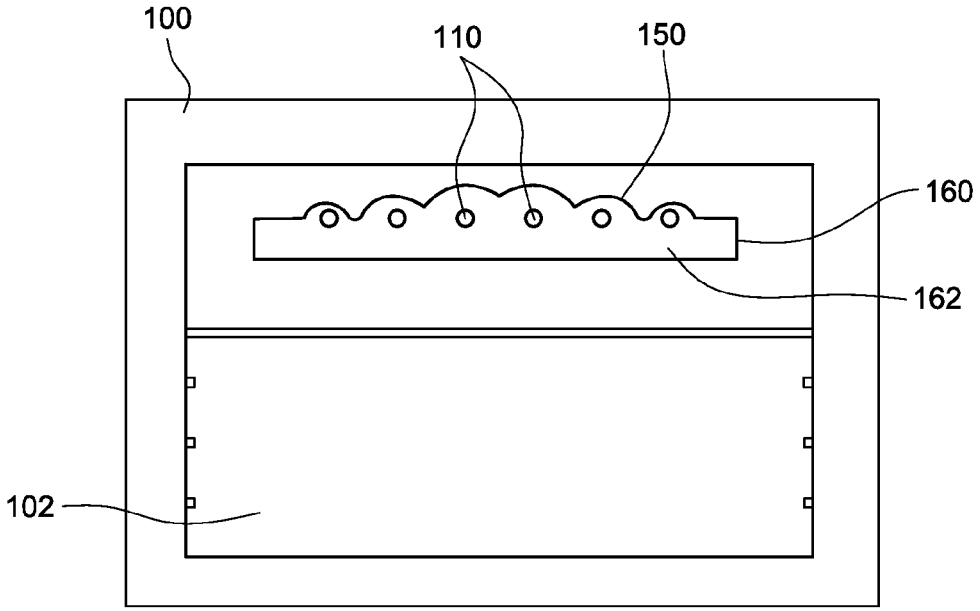
FIG. 7 is a cross-sectional view of an oven with a reflector having curved segments with varying focal lengths, side reflecting portions and a rear reflecting portion.

FIG. 7 illustrates another embodiment of a reflector 150 which has curved segments with varying focal lengths. In this embodiment, the reflector also includes side reflecting portions 160 and a rear reflecting portion 162. As explained above, the side reflecting portions 160 and rear reflecting portion also help to reflect a greater amount of the radiant energy produced by the side and rear portions of the heating element downward onto the underlying rack 106, which promotes more even cooking of food items distributed across the rack 106.

Figure 8:
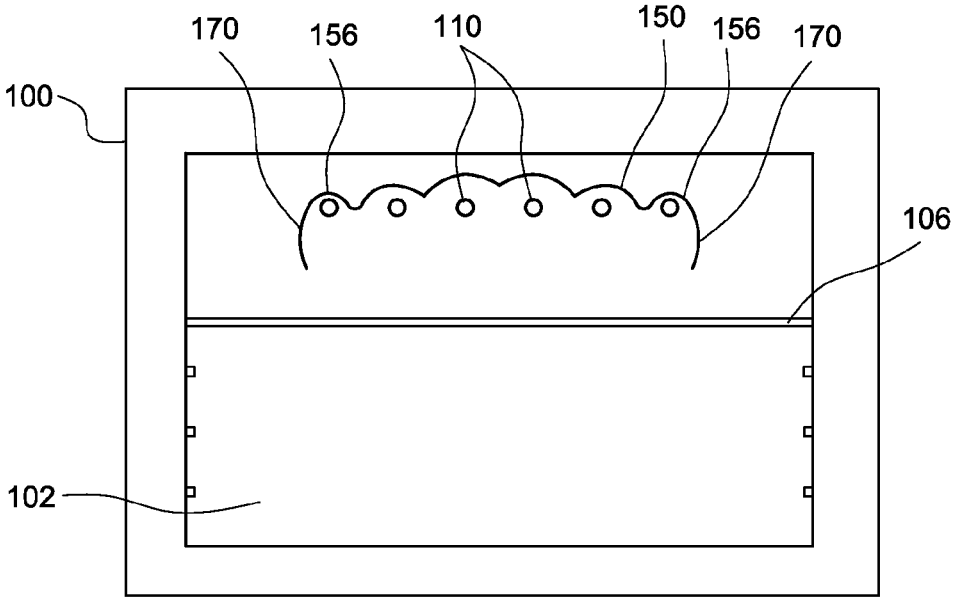
FIG. 8 is a cross-section view of an oven with a reflector having curved segments with varying focal lengths, and curved side reflecting portions.

FIG. 8 illustrates another embodiment where the reflector 150 includes a plurality of curved segments with varying focal lengths. This reflector also includes side reflecting portions 170. In this embodiment, however, the side reflecting portions 170 are essentially extensions of the curved segments 156 located on the sides of the main body of the reflector 150.

Figure 9:
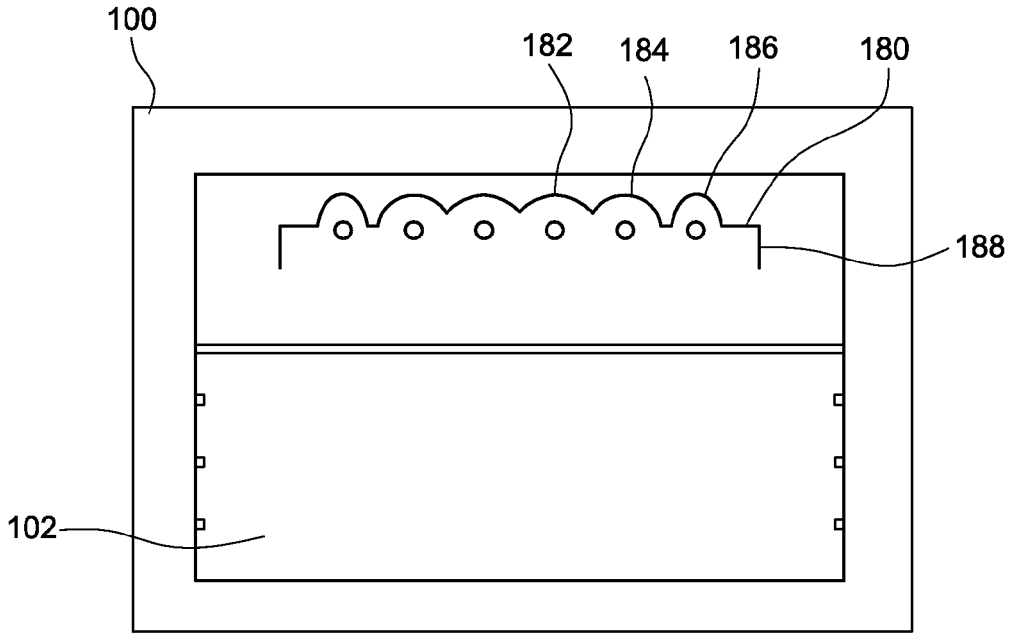
FIG. 9 is a cross-sectional view of an oven with a reflector having curved segments with varying focal lengths, where each of the curved segments is positioned substantially the same distance away from corresponding heating elements.

FIG. 9 illustrates another embodiment where the reflector 180 includes a plurality of curved segments 182, 184, 186 with varying focal lengths. However, unlike the embodiment illustrated in FIG. 6, the reflector 180 is shaped such that a distance between the curved segments and the corresponding straight segments 110 of the heating element is essentially the same for all of the curved segments. In other words, the curved segments 186 at the sides of the cooking cavity, which have a relatively small focal length, are the same distance from their corresponding straight segments 110 of the heating element as the curved segments 182 with larger focal lengths. This embodiment also includes side reflecting portions 188 that extend downwards from the main body of the reflector at approximately a perpendicular angle.

In some of the embodiments described above, side reflecting portions and/or a rear reflecting portion are provided on a reflector to help direct radiant energy produced by portions of a heating element located at edges of a cooking cavity downward onto an underlying oven rack. In other embodiments, a front reflecting portion could also be provided on a reflector to help re-direct radiant energy produced by portions of a heating element located at the front of a cooking cavity downward onto an underlying rack.

As described above, a reflector for an electric oven can be designed such that the heat energy produced by a heating element and delivered onto food on an oven rack is distributed evenly across the rack. This can be accomplished using side reflecting portions, a rear reflecting portion and/or a front reflecting portion. This can also be accomplished by providing curved segments designed to reflect radiant energy emitted upward from portions of a heating element downward onto an underlying rack, where the curved segments located at the center of the cooking cavity have a longer focal length than the curved segments located at sides of the cooking cavity. These curved segments could have parabolic or other shapes to help focus the radiant energy toward desired locations.

In the embodiments illustrated above, the heating element includes multiple straight segments that are aligned parallel to each other. In alternate embodiments, the shape of the heating element could take on any desired shape or pattern. However, the concept of reflecting radiant energy produced from portions of the heating element located at sides of the cooking cavity inward with side, rear and front reflecting portions would remain the same. Likewise, the concept of using curved segments with varying focal lengths to achieve a more even distribution of the heat across an underlying rack would also remain the same.

The reflectors illustrated above were shown as being made of one consolidated unitary form. In alternate embodiments, a reflector system made of up multiple different individual reflectors could accomplish the same functions.

Likewise, in the embodiments illustrated above, a single unitary heating element is used. In alternate embodiments, multiple individual heating elements could be used. While the number, orientation and shape of the heating elements could vary, the reflector design considerations would remain essentially the same.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A cooking appliance, comprising:

a housing having a cooking cavity;

a heating element mounted inside the cooking cavity, wherein the heating element comprises a plurality of substantially straight segments that are arranged parallel to one another;

a cooking surface located under the heating element; and a reflector mounted in the cooking cavity above the heating element, wherein the reflector is configured to reflect radiation emitted by the heating element toward the cooking surface, wherein a main body portion of the reflector includes a plurality of curved segments, each curved segment being aligned with a corresponding one of the straight segments of the heating element, and wherein a curved segment located at a central portion the cooking cavity has a larger focal length than a curved segment located at a side of the cooking cavity, wherein a first curved segment of the reflector located at a central portion of the cooking cavity has a first focal length, wherein a second curved segment of the reflector located at a side portion of the cooking cavity has a second focal length that is smaller than the first focal length, and wherein a third curved segment of the reflector having a third focal length that is smaller than the first focal length but greater than the second focal length is located between the first curved segment and the second curved segment.

2. The cooking appliance of claim 1, wherein the curved segments of the reflector have a parabolic shape.

3. The cooking appliance of claim 1, wherein the curved segments of the reflector have a parabolic shape.

4. The cooking appliance of claim 1, wherein the curved segments of the reflector having the largest focal lengths are located further away from their corresponding straight segments of the heating element than the curved segments of the reflector having the smallest focal lengths.

5. The cooking appliance of claim 1, wherein a center of each of the curved segments of the reflector are located at substantially the same distance from their corresponding straight segments of the heating element.

6. The cooking appliance of claim 1, wherein the reflector further comprises side reflector portions that are located at side edges of the reflector, the side reflector portions extending downward from the main body portion of the reflector towards the cooking surface.

7. The cooling appliance of claim 6, wherein the side reflector portions form a substantially perpendicular angle with the main body portion of the reflector.

8. The cooking appliance of claim 6, wherein the side reflector portions form an oblique angle with the main body portion of the reflector.

9. The cooking appliance of claim 6, wherein the side reflector portions comprise curved surfaces that are an extension of the curved segments of the reflector located at side edges of the main body of the reflector.

10. The cooling appliance of claim 6, wherein the reflector further comprises a rear reflector portion that is located at a rear edge of the reflector at a rear of the cooking cavity, the rear reflector portion extending downward from the main body portion of the reflector towards the cooking surface.

11. A reflector for a cooking appliance, the reflector being configured to be mounted above a plurality of substantially straight heating element segments that extend parallel to one another, the reflector comprising:

a first curved segment located at a central portion of the reflector and having a first focal length, the first curved segment being configured to reflect radiation emitted from a first straight heating element segment; and a second curved segment located at a side portion of the reflector and having a second focal length that is smaller than the first focal length, the second curved segment being configured to reflect radiation emitted from a second straight heating element segment, a third curved segment located between the first curved segment and the second curved segment having a third focal length that is smaller than the first focal length but greater than the second focal length.

12. The reflector of claim 11, wherein the curved segments of the reflector have a parabolic shape.

13. The reflector of claim 11, wherein the reflector is shaped such that when it is mounted in a cooking cavity of a cooking appliance above a plurality of substantially straight heating element segments that extend parallel to one another, a center portion of the first curved segment is located farther away from its corresponding heating element segment than a center portion of the second curved segment is located from its corresponding heating element segment.

14. The reflector of claim 11, wherein the third curved segment being configured to reflect radiation emitted from a third straight heating element segment.

15. The cooking appliance of claim 1, wherein the curved segment located at a central portion the cooking cavity and the curved segment located at a side of the cooking cavity both have finite focal lengths.

16. The cooking appliance of claim 1, wherein each of the curved segments is vertically centered with the corresponding one of the straight segments of the heating element and the curved segment located at a central portion the cooking cavity is further than the curved segment located at a side of the cooking cavity from their respective vertically centered curved segments.

17. The cooking appliance of claim 16, wherein the straight segments are substantially co-planar.

* * * * *